US007597142B2

(12) United States Patent
Hartog et al.

(10) Patent No.: US 7,597,142 B2
(45) Date of Patent: Oct. 6, 2009

(54) SYSTEM AND METHOD FOR SENSING A PARAMETER IN A WELLBORE

(75) Inventors: Arthur H. Hartog, Winchester (GB); Hubertus V. Thomeer, Houston, TX (US); Martin E. Poitzsch, Derry, NH (US); Benjamin P. Jeffryes, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 229 days.

(21) Appl. No.: 11/612,262

(22) Filed: Dec. 18, 2006

(65) Prior Publication Data

US 2008/0142212 A1 Jun. 19, 2008

(51) Int. Cl.
*E21B 47/00* (2006.01)

(52) U.S. Cl. ..... 166/250.01; 166/66

(58) Field of Classification Search ..... 166/250.01, 166/250.11, 66

See application file for complete search history.

(56) References Cited

U.S. PATENT DOCUMENTS

| | | | | |
|---|---|---|---|---|
| 4,676,563 | A | 6/1987 | Curlett | |
| 4,685,516 | A | 8/1987 | Smith | |
| 4,690,212 | A | 9/1987 | Termohlen | |
| 4,799,544 | A | 1/1989 | Curlett | |
| 4,810,010 | A | 3/1989 | Jones | |
| 5,330,236 | A | 7/1994 | Peterjohn | |
| 5,392,851 | A | 2/1995 | Arend | |
| 5,435,395 | A | 7/1995 | Connell | |
| 5,469,916 | A | 11/1995 | Sas-Jaworsky | |
| 5,485,745 | A | 1/1996 | Rademaker | |
| 5,524,937 | A | 6/1996 | Sides, III et al. | |
| 5,944,099 | A | 8/1999 | Sas-Jaworsky | |
| 5,988,702 | A | 11/1999 | Sas-Jaworsky | |
| 6,082,454 | A | 7/2000 | Tubel | |
| 6,161,622 | A | 12/2000 | Robb | |
| 6,202,749 | B1 | 3/2001 | Adams | |
| 6,332,499 | B1 | 12/2001 | Kobylinski | |
| 6,364,368 | B1 | 4/2002 | Kilgore | |
| 6,766,853 | B2 | 7/2004 | Restarick | |
| 6,983,796 | B2 * | 1/2006 | Bayne et al. | 166/278 |
| 2002/0007645 | A1 | 1/2002 | Jeuch | |
| 2004/0194950 | A1 | 10/2004 | Restarick | |
| 2005/0016730 | A1 * | 1/2005 | McMechan et al. | 166/305.1 |
| 2007/0044960 | A1 * | 3/2007 | Lovell et al. | 166/250.07 |

FOREIGN PATENT DOCUMENTS

| | | | |
|---|---|---|---|
| GB | 2354782 | A | 4/2001 |

* cited by examiner

*Primary Examiner*—William P Neuder
(74) *Attorney, Agent, or Firm*—Rodney Warfford; David Cate; Robin Nava

(57) ABSTRACT

A technique enables sensing one or more wellbore parameters along a specific well zone. A section of instrumented coiled tubing is provided with a sensor array extending along its exterior. The sensor array is designed to sense well fluid related parameters and may comprise an optical fiber sensor. A cross-over allows the sensor array to communicate with a surface location via a control line routed along a coiled tubing interior.

23 Claims, 4 Drawing Sheets

SYSTEM AND METHOD FOR SENSING A PARAMETER IN A WELLBORE

BACKGROUND

In many wellbore applications, it is desirable to make parameter measurements in specific zones, such as a treatment zone. For example, measurements of pressure, temperature and/or vibration in or close to a production interval can provide valuable data from which the performance of the well and the efficacy of treatment operations can be analyzed. Obtaining such data, however, has proved to be problematic.

For example, some well production and well treatment operations utilize coiled tubing deployed into a wellbore. Sensors can be deployed externally of the coiled tubing, but this creates operational problems in that it often is necessary or desirable to maintain a constant outside diameter of the coiled tubing so that it may be inserted through an appropriate stuffing box. For other types of well operations, coiled tubing has been designed with control lines extending along the coiled tubing interior or through a port in a wall of the coiled tubing. Such control lines, however, cannot be used to obtain desired parameter measurements along a specific well zone because the placement does not provide sufficient exposure to external well fluids. Attempts also have been made to place sensors in downhole equipment, such as bottom hole assemblies, but this approach only allows measurement of well related parameters in the vicinity of the downhole equipment.

SUMMARY

In general, the present invention provides a system and method for sensing one or more wellbore parameters along a specific well zone. An instrumented section of coiled tubing is provided with a sensor array, e.g. an optical fiber sensor, extending along its length. In one embodiment, an optical fiber is held within a recess formed in a tubing wall surface of the instrumented section. A cross-over routes the exposed optical fiber from the instrumented section to an interior of the coiled tubing.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and methodology for sensing one or more well related parameters in a wellbore environment. An array of sensors, e.g. an optical fiber sensor, is disposed along an outer wall of an instrumented section of coiled tubing. In one embodiment, a recess is formed in a wall of the coiled tubing and one or more optical fibers are laid in the recess. The optical fibers may be overcoated to form an external sensing surface substantially flush with a circumference of the coiled tubing. Also, a cross-over directs the one or more optical fibers from the external surface of the instrumented section to an interior of the coiled tubing so the optical fibers are protected between the instrumented section and, for example, a surface location.

In this embodiment, the embedded optical fiber or optical fibers can be used to provide, for example, measurements of temperature distribution which, in turn, can be interpreted for determining flow into, or emerging from, the surrounding formation. The optical fiber also can be made sensitive to pressure either on a distributed or on a multi-point basis. In many applications, the pressure distribution can be used to complement the temperature profile, thus enhancing the interpretation of fluid movement. The optical fiber or fibers also can be used for strain measurement to detect, for example, deformation of the coiled tubing which can result from coil tubing buckling, bottoming of the coiled tubing, and other well operation events. The optical fiber also can be used to sense vibrations that can be interpreted in terms of transported solids and/or transient measurement of fracture growth. The detection of strain on the coiled tubing itself also can be indicative as to whether the optical fiber is properly strain-coupled to the coiled tubing. Accordingly, individual or multiple optical fibers deployed substantially flush with a coiled tubing surface can be used to detect one or more parameters related to the well.

Figure 1:
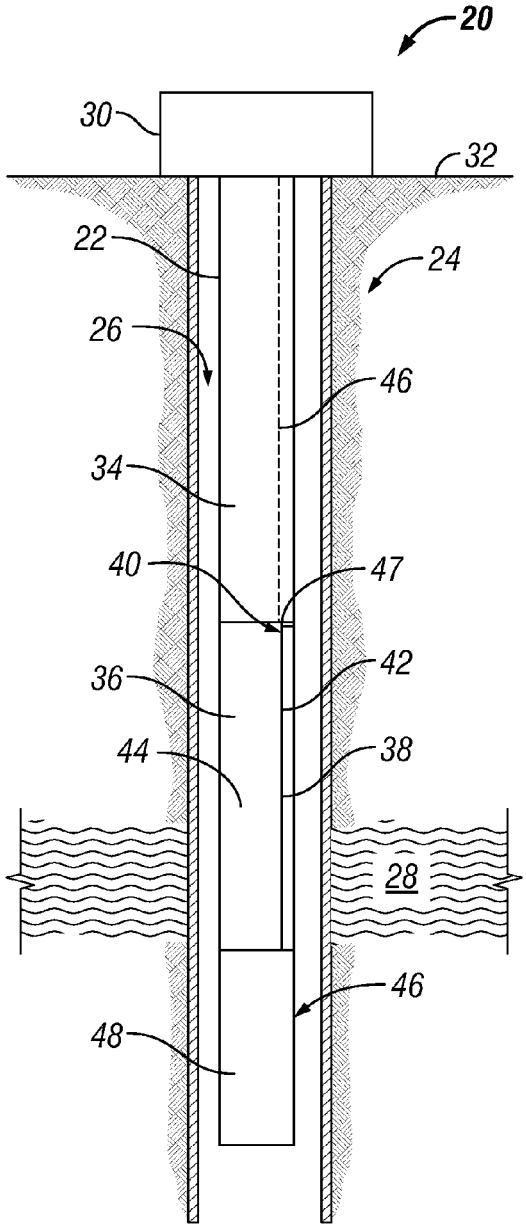
FIG. 1 is a front elevation view of a coiled tubing string disposed in a wellbore, according to an embodiment of the present invention.

Referring generally to FIG. 1, a system 20 is illustrated according to an embodiment of the present invention. In the particular embodiment illustrated, system 20 comprises a well assembly 22 disposed in a well 24 having a wellbore 26 drilled into a formation 28. Formation 28 may hold desirable production fluids, such as oil. Well assembly 22 extends downwardly into wellbore 26 from, for example, a wellhead 30 that may be positioned along a surface 32, such as the surface of the earth or a seabed floor. The wellbore 26 may be formed as a vertical wellbore or a deviated, e.g. horizontal, wellbore.

In the embodiment illustrated in FIG. 1, well assembly 22 comprises a coiled tubing 34 and a coiled tubing section 36 that is instrumented. In some embodiments, instrumented coiled tubing section 36 is relatively short compared with the total length of coiled tubing 34. In such applications, instrumented coiled tubing section 36 can be used to make measurements in a specific zone, such as a treatment zone. The illustrated coiled tubing section 36 comprises a recess 38 into which a sensor array 40 is positioned. By way of example, coiled tubing 34 may be standard diameter coiled tubing and the diameter of coiled tubing section 36 (taken directly through the sensor array 40) may be the same as the diameter of standard coiled tubing 34. In the embodiment of FIG. 1, sensor array 40 comprises an optical fiber 42 or a plurality of optical fibers 42 that are deployed in recess 38. The optical fibers 42 may be held substantially flush with a circumferential surface 44, such as the exterior surface of coiled tubing section 36.

Furthermore, the one or more optical fibers 42 may be part of or connected to an additional optical fiber section 46 via a cross-over 47 that enables deployment of the additional optical fiber section 46 along the interior of coiled tubing 34. Optical fiber section 46 extends along coiled tubing 34 to, for example, a surface location. By holding the optical fiber 42 substantially flush with the circumferential surface 44 of coiled tubing section 36, selected well-related parameters can be accurately sensed on a multi-point or distributed basis. Additionally, cross-over 47 limits exposure of the optical fiber or fibers by enabling routing of the optical fiber section 46 along a protected interior of the coiled tubing. In the embodiment of FIG. 1, recess 38 and optical fiber section 42 are deployed in a generally linear fashion along the length of coiled tubing section 36.

Well assembly 22 also may include well equipment 46 coupled to coiled tubing section 36. Well equipment 46 may comprise optical fibers or other sensors as well as fiber optic connectors for coupling optical fiber 42 to other sections of optical fiber, as explained in greater detail below. By way of example, well equipment 46 may comprise a bottom hole assembly 48.

Figure 2:
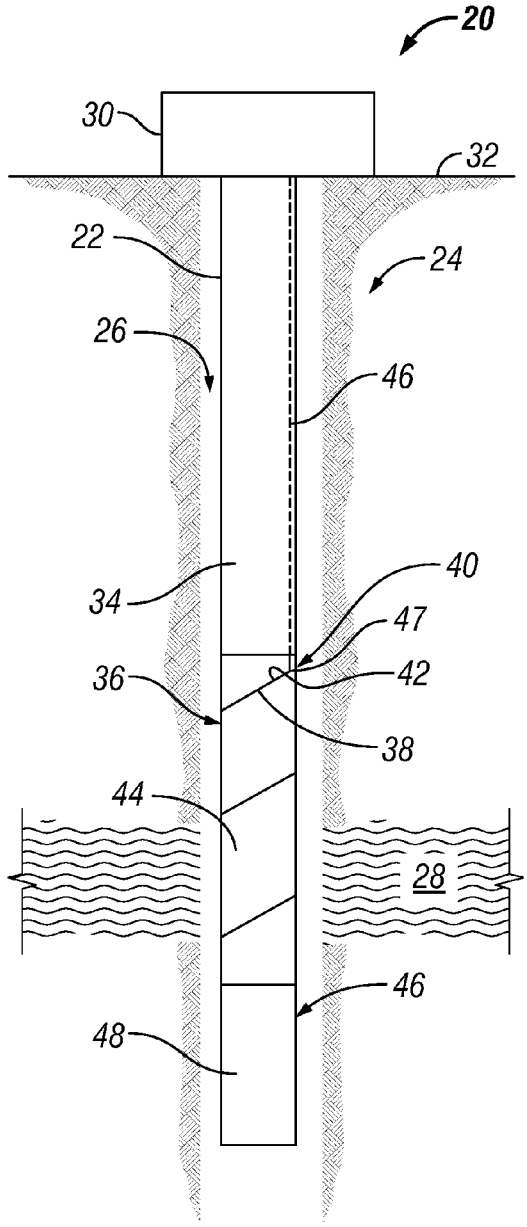
FIG. 2 is another embodiment of a coiled tubing string disposed in a wellbore, according to an embodiment of the present invention.

In another embodiment, the recess 38 and the one or more optical fibers 42 within recess 38 are arranged in a curved pattern along coiled tubing section 36, as illustrated in FIG. 2. In the specific example illustrated, recess 38 is arranged in a generally helical pattern along the outer circumference of coiled tubing section 36. The use of curved recess 38 and curved optical fiber 42 can reduce the amount of stress and strain acting on the optical fiber in some types of applications. For example, depending on the length of instrumented coiled tubing section 36, the optical fiber 42 embedded in the wall of the coiled tubing may need to withstand or avoid substantial strain experienced by the coiled tubing section. The use of a curved, e.g. helical, path accommodates this strain in the coiled tubing without detrimentally affecting use of the optical fiber.

Figure 3:
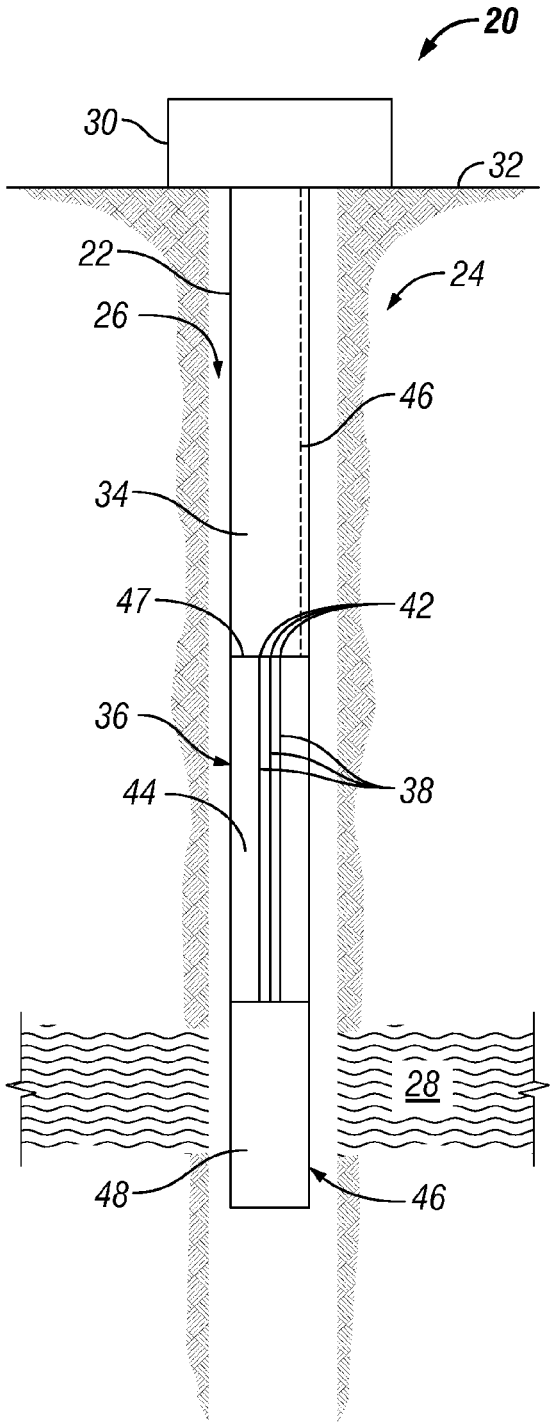
FIG. 3 is another embodiment of a coiled tubing string disposed in a wellbore, according to an embodiment of the present invention.

Referring generally to FIG. 3, another embodiment of well assembly 22 is illustrated in which coiled tubing section 36 comprises a plurality of recesses 38 that may be arranged in a linear or curved manner. Each of the recesses 38 is designed to receive an optical fiber 42 for measuring specific well related parameters. In some applications, a plurality of optical fibers 42 can be deployed in each recess 38.

Figure 4:
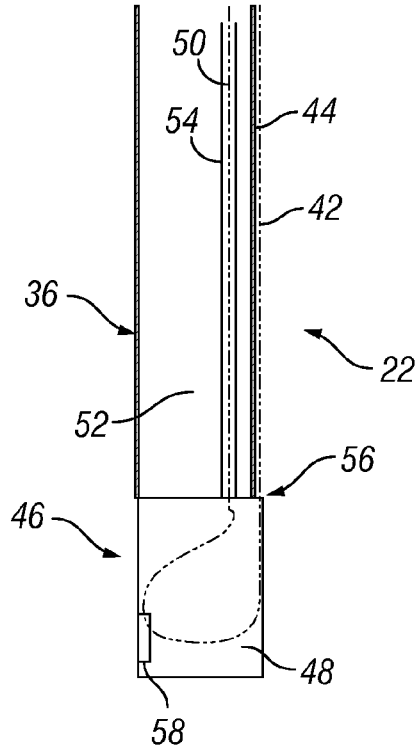
FIG. 4 is a schematic illustration of a section of coiled tubing coupled to downhole equipment, according to an embodiment of the present invention.

One embodiment of coiled tubing section 36 and wellbore equipment 46 is illustrated in FIG. 4. In this embodiment, the optical fiber section 42 of instrumented coiled tubing section 36 is connected to a second optical fiber section 50 deployed within instrumented coiled tubing section 36 and coiled tubing 34. For example, second optical fiber section 50 may be deployed along an interior 52 of coiled tubing 34 and instrumented coiled tubing section 36. The second optical fiber 50 may be deployed within a cable formed by a small tube 54, such as a stainless steel tube. The stainless steel tube may be installed into the coiled tubing by a fluid drag technique or other techniques for moving cables through coiled tubing.

In the specific embodiment illustrated, the small tube 54 is sealed to wellbore equipment 46, e.g. sealed to bottom hole assembly 48. Second optical fiber section 50 is coupled to optical fiber 42 as a single fiber or as joined fibers through an appropriate cross-over 56 such that an optical fiber loop is formed that includes optical fiber 42 embedded in coiled tubing section 36. In many applications, the optical fiber loop can extend downhole from a surface location. To the extent the second optical fiber section 50 extends through bottom hole assembly 48, the bottom hole assembly serves to protect the optical fiber from chemical and/or mechanical degradation. The downhole equipment 46, e.g. bottom hole assembly 48, also can be designed to allow for a plurality of optical fibers 50 to be deployed through tube 54 so that separate optical fibers can be utilized in different ways downhole. For example, one or more of the optical fibers can be coupled to one or more optical fibers 42, and other optical fibers can be coupled to, for example, sensors 58 within bottom hole assembly 48. The components of well assembly 22 also can be used in other arrangements. Bottom hole assembly 48, for instance, can be deployed between coiled tubing section 36 and the remainder of coiled tubing 34. Additionally, the one or more optical fibers can be placed in a snubbable connector.

Figure 5:
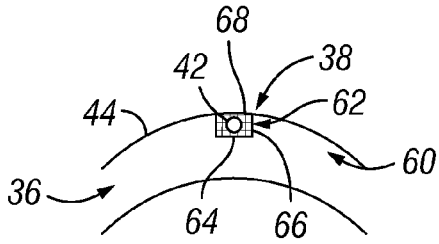
FIG. 5 is a cross-sectional view of an optical fiber deployed in a section of coiled tubing, according to an embodiment of the present invention.

With respect to instrumented coiled tubing section 36, the recess or recesses 38 can be formed in a wall 60 of coiled tubing section 36, as illustrated in FIG. 5. The optical fiber 42 is held at a desired position, e.g. substantially flush, with respect to circumferential wall surface 44 via a mechanism 62. Mechanism 62 may comprise a variety of structures or systems that support optical fiber 42 substantially along the circumferential surface to facilitate accurate collection of data.

Recess 38 may be formed according to a variety of methods. For example, recess 38 may be in the form of a groove 64 cut into wall 60 of coiled tubing section 36. Groove 64 can be cut into a completed coiled tubing section using a grinding type of cutting tool. For example, a milling station can be used to cut groove 64 as the section of coiled tubing is fed past a rotating milling tool that cuts a groove of a desired profile. If several grooves are required, a plurality of cutting heads can be used simultaneously to cut multiple grooves in the coiled tubing. Alternatively, a laser can be used to remove the desired quantity of material for creating recess 38. Furthermore, the recess 38 can be formed in sheet material prior to forming and welding the sheet material into the section of coiled tubing. The recess, e.g. groove 64, also can be formed during the rolling stage of material processing such that the recess is effectively embossed in the sheet material prior to forming the sheet material into the section of coiled tubing. These and other techniques can be used to form recess 38 in a desired shape and size.

Furthermore, recesses 38 can be straight or curved depending on the desired application. For example, placement of optical fiber 42 in a straight groove can be used to facilitate the detection of strain due to, for example, tension and buckling in the coiled tubing. In other applications, it is preferred to decouple the sensing array from strain on the coiled tubing. In these applications, groove 64 can be cut or otherwise formed in a helical or serpentine fashion to buffer optical fiber 42 from strain on coiled tubing section 36. The optical fiber 42 also can be deployed in a loosely bound or tightly bound fashion within the recess 38 depending on the parameters to be measured. For example, placement of the tightly bound optical fiber 42 in a generally helical groove can be useful in measuring strain due to torque on the section of coiled tubing during coiled tubing drilling or other torque inducing operations.

Mechanism 62 also is selected according to the type of well operation in which instrumented coiled tubing section 36 is utilized. For example, optical fiber 42 can be potted in a filler material 66, such as an adhesive, an epoxy, a softer material (e.g. curable rubber), or a material that does not fully set, (e.g. a silicone gel). In some applications, optical fiber 42 can be hermetically sealed in recess 38. Such hermetic seal can be achieved, for example, by welding a thin cover plate 68 directly on top of optical fiber 42. One example of suitable welding is laser welding. In other applications, however, the optical fiber 42 is potted in a compound without sealing recess 38 hermetically. Whether the hermetic seal is created depends on design parameters, such as required longevity and the measurands to be sensed.

The use of instrumented coiled tubing section 36 improves the efficiency and effectiveness of well related operations, including well treatment operations. During a well operation, coiled tubing section 36 may be deployed in the same way coiled tubing is deployed in conventional applications and used to measure relevant properties of the well. In some applications, coiled tubing section 36 is placed in a region of well 24 that is subjected to hydraulic pressure supplied via coiled tubing 34. Based on data obtained from instrumented coiled tubing section 36, the pumping or well treatment process is modified to optimize the process time, volume of fluids pumped, and treatment effectiveness. Such modification also can be based on other data collected from, for example, sensors at the bottom hole assembly and the surface as well as data on the settings of pumps or other machinery. Instrumented coiled tubing section 36 also can be used to obtain well performance data and other measurement data from a variety of operations ranging from, for example, drilling operations to well completion operations. The instrumented coiled tubing section is able to provide information that enables optimization and confirmation of the effectiveness of the operation both to the provider of services and to their customers.

The types of measurements taken and the parameters selected for measurement via instrumented coiled tubing section 36 can vary from one application to another. In some applications, temperature profiles are measured using optical fiber 42 which is readily utilized for distributed temperature sensing. In this type of application, optical fiber 42 may be a multimode, graded-index type of fiber for use in downhole applications. The distributed temperature measurement is based on Raman backscatter, and the position resolution is achieved either with time-domain reflectometry or frequency-domain reflectometry. In either case, the position is related to the time of flight from the equipment to the point of interest, and the temperature information is encoded as a modulation of the anti-Stokes Raman backscatter. Raman scattering arises from the interaction between a probe light and molecular vibrations. This method also can be applied to single-mode optical fibers. In single mode optical fibers, however, an alternative can be employed in which Brillouin backscattered light is used. In this latter approach, sensitivity of frequency shift and intensity are related to both temperature and strain and can be used for measuring both parameters independently.

Other parameters also can be measured with instrumented coiled tubing section 36. For example, optical fiber 42 can be used to measure pressure and dynamic strain. With respect to measuring pressure, it is known that physical length is affected by isostatic pressure and that a small corresponding elasto-optic effect operates in the opposite direction. This effect can be enhanced substantially by coating the optical fiber 42 with certain known coatings. The axial strain on optical fiber 42 resulting from pressure on the optical fiber can be detected using the Brilloiun technique. Other methods include the use of polarization OTDR in the optical fiber to vary the birefringence of the optical fiber as a function of pressure.

In another approach, optical fiber 42 can be divided into array elements, separated by reflectors and interrogated interferometrically at several frequencies to establish the absolute path length between reflectors. This technique can be used for high-resolution temperature, pressure and strain measurement.

The instrumented coiled tubing section 36 also can be used in other optical sensing methods and for measuring other parameters, such as electric and magnetic fields. Additionally, the presence of certain chemical species can be converted to strain through the use of special coatings. If a heating or cooling device is provided, the measurement of temperature distribution can be converted to a flow profile using available anemometry and heat-tracing methods. Optical fiber 42 also can be used to detect solids hitting the coiled tubing. Coiled tubing section 36 also can be used to monitor fracture growth through dynamic pressure sensors, e.g. hydrophones, built into instrumented coiled tubing section 36.

In many applications, optical fiber 42 of instrumented coiled tubing section 36 is connected to other optical fibers, such as second optical fiber 50, or other optical fiber sections extending to specific well equipment or regions of the wellbore. By way of example, the connection of optical fibers can be achieved through a non-contact telemetry connector or other type of connector, such as a pluggable connector. A variety of connectors can be used in forming crossover type connections between external and internal optical fibers and other types of connections between optical fibers.

Figure 6:
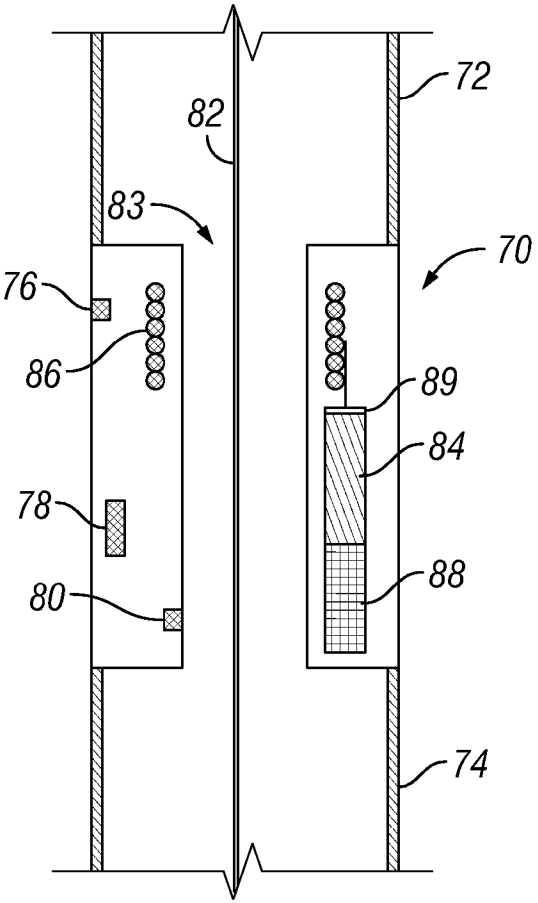
FIG. 6 is a schematic illustration of a connector for use in connecting coiled tubing sections in a wellbore, according to another embodiment of the present invention.

Connectors also can be used to connect sections of coiled tubing that carry optical fibers. One example of a connector for coupling sequential sections of coiled tubing is a non-contact telemetry connector, an embodiment of which is illustrated in FIG. 6. In this embodiment, a coiled tubing connector 70 is used to join a first section of coiled tubing 72 with a second section of coiled tubing 74. The coiled tubing connector 70 may be an internal connector, an external connector, a flush, e.g. spoolable, connector, or another type of suitable connector. In some applications, at least one of the coiled tubing sections 72 and 74 can be an instrumented coiled tubing section, such as coiled tubing section 36. One or more sensors, e.g. sensors 76, 78 and 80, are embedded in coiled tubing connector 70 or in coiled tubing sections 72, 74 proximate connector 70. In the example illustrated, sensor 76 is positioned to detect environmental conditions outside of connector 70; sensor 78 is positioned to detect conditions within the body of connector 70; and sensor 80 is positioned to detect conditions within tubing connector 70. The detected parameters can be transmitted uphole via an optical fiber 82 that extends along coiled tubing sections 72, 74 and through an optical fiber passage 83 of connector 70.

The data collected on well conditions proximate connector 70 can be transmitted through optical fiber 82 via non-contact telemetry. For example, connector 70 may further comprise a processor 84, such as a microprocessor, which is able to convert sensor data into digital form. Processor 84 also is used to modulate a signal transfer mechanism 86, such as a magnetic coil, which affects the passage of light through optical fiber 82. Connector 70 further comprises a power supply 88 which can be in the form of a battery pack, fuel cell or capacitive energy storage unit able to power processor 84 and transfer mechanism 86. Alternatively, processor 84 can be used to output data via an acoustic generator, such as a buzzer 89 that imparts an acoustic modulation onto optical fiber 82.

Figure 7:
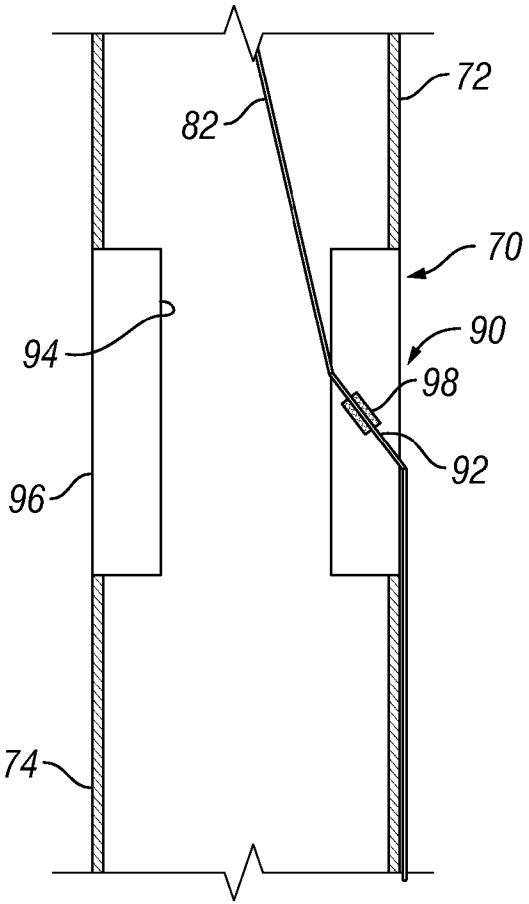
FIG. 7 is a schematic illustration of a connector, according to another embodiment of the present invention.

In another embodiment, coiled tubing connector 70 is a side exit sub connector having a side exit region 90 with an optical fiber passage 92 extending from an interior 94 to an exterior 96 of connector 70, as illustrated in FIG. 7. Optical fiber 82 is deployed through optical fiber passage 92 between interior 94 and exterior 96. In some applications, coiled tubing section 74 comprises an instrumented coiled tubing section, e.g. coiled tubing section 36, and optical fiber 82 is coupled to embedded optical fiber 42 for measurement of well related properties, e.g. pressure, temperature, and flow velocity, in the surrounding annulus. A pressure seal 98 may be deployed around optical fiber 82 within side exit region 90 to form a fluid seal about the fiber.

Figure 8:
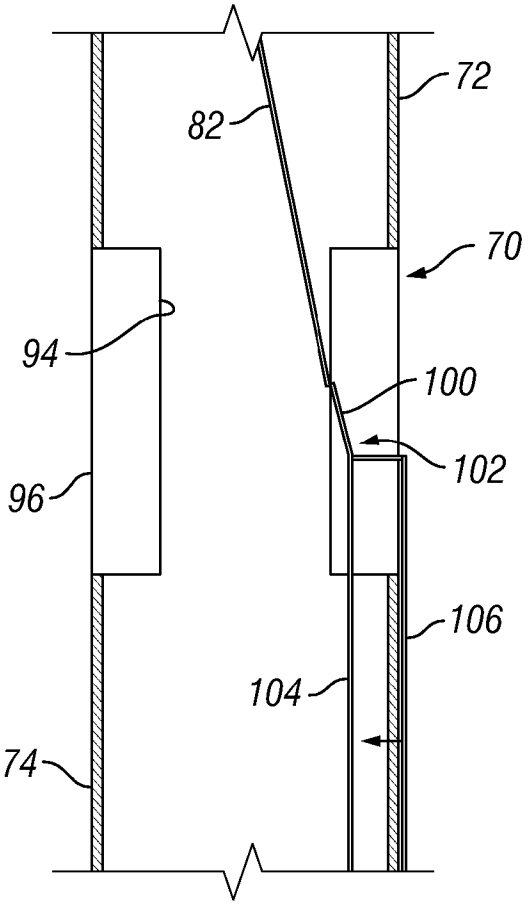
FIG. 8 is a schematic illustration of a connector, according to another embodiment of the present invention.

Coiled tubing connector 70 also can be designed as a T-joint sub, as illustrated in FIG. 8. In this embodiment, optical fiber 82 comprises a plurality of individual optical fibers that may be grouped in an optical fiber cable extending downwardly along coiled tubing section 72. The plurality of optical fibers 82 may be deployed within coiled tubing section 72 and routed into coiled tubing connector 70 along an optical fiber passage 100. This embodiment of coiled tubing connector 70 comprises a splitting element 102 designed to split optical fiber cable 82 into two or more optical fibers, e.g. optical fiber 104 and optical fiber 106. Splitting element 102 also may be designed to form a seal around optical fibers 82. Furthermore, the two or more individual optical fibers can be directed to a plurality of wellbore regions for measuring desired well related parameters. By way of example, coiled tubing section 74 may comprise an instrumented coiled tubing section, e.g. coiled tubing section 36, and optical fiber 104 can be routed along the interior of coiled tubing section 74 while optical fiber 106 is embedded in the external surface of the instrumented coiled tubing section to measure fluid parameters within the surrounding annulus. The placement of the optical fiber 106 also could be adjusted to sense other parameters, such as tubing pressure.

Figure 9:
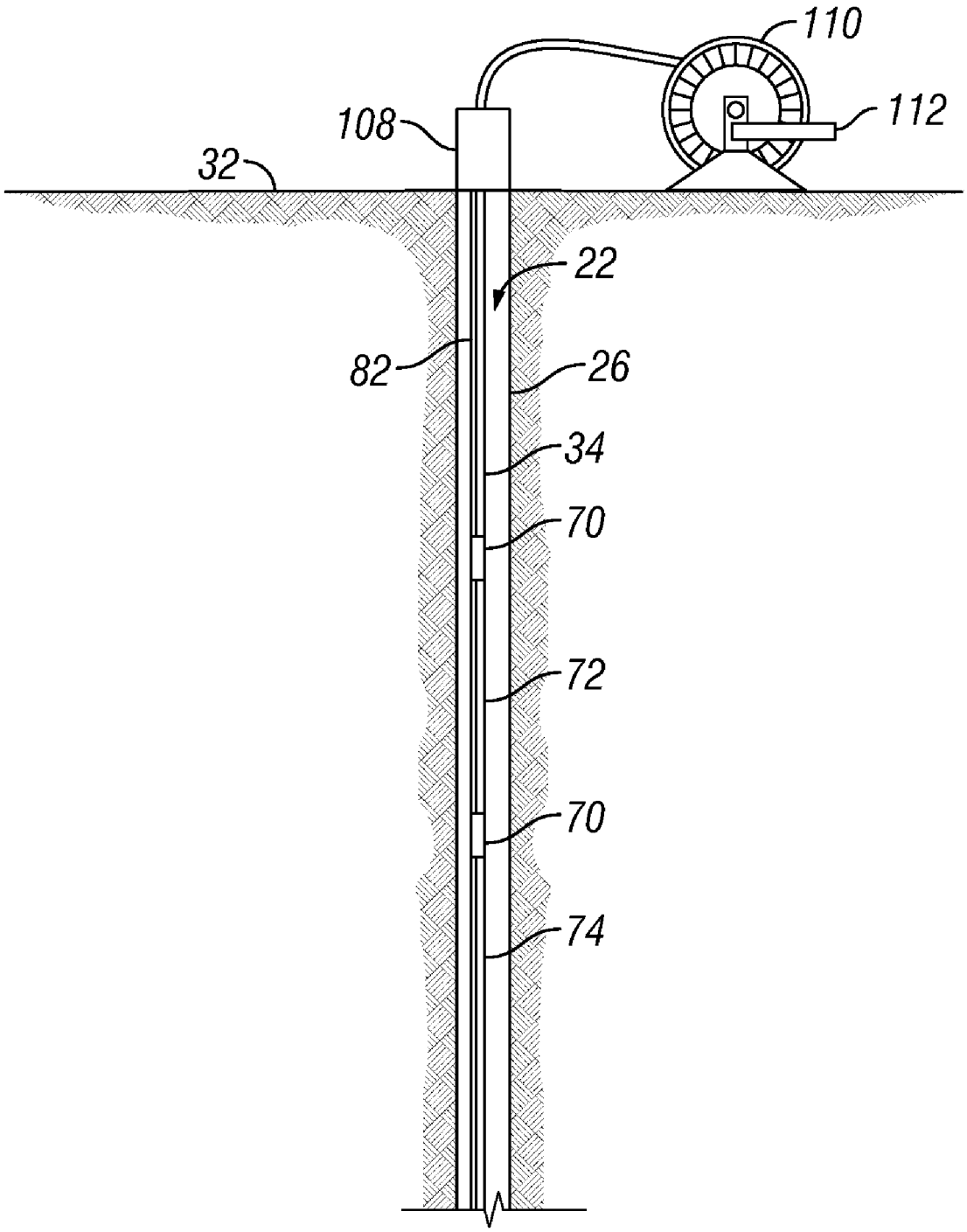
FIG. 9 is a front elevation view of a tubing string with fiber-optic connectors deployed in a wellbore, according to an embodiment of the present invention.

There are many uses for coiled tubing connectors 70. One use is illustrated in FIG. 9 in which a plurality of coiled tubing sections, e.g. sections 34, 72 and 74, are coupled together by a plurality of coiled tubing connectors 70. The coiled tubing sections are deployed into wellbore 26 through a pressure seal 108 located at surface 32. The coiled tubing sections are moved through pressure seal 108 and into or out of wellbore 26 by a powered coil 110. Additionally, optical fiber 82, which may be one or more individual fibers in the form of an optical fiber cable, is deployed along the coiled tubing sections and is connected to a laser system 112 at its upper end. At least a portion of the optical fiber 82 can be contained within the coiled tubing, however one or more optical fibers can be directed outwardly at an appropriate connector 70 for sensing well related parameters along the exterior of the coiled tubing. The sensing of well related parameters along the exterior can be accomplished with an instrumented coiled tubing section, such as coiled tubing section 36 described above. Furthermore, laser system 112 is used to interrogate the optical properties of the optical fibers, thus allowing data to be conveyed from the subsurface to a surface collection location for analysis.

Numerous potential parameters are detectable with instrumented coiled tubing section 36, instrumented connectors 70, and/or other sensors deployed downhole and coupled to optical fibers. Pressure and temperature can be measured along both the exterior and the interior of the coiled tubing on a distributed temperature or multipoint basis. The interior pressure and temperature may be used to infer properties of the downhole rheology of the fluids being pumped. Active acoustic measurements can be made with appropriate transmitters and receivers, and those measurements can be used to determine properties of the exterior fluid, e.g. inferring fluid velocity from the Doppler effect.

Other measurements obtained from the downhole sensors or sensor arrays, e.g. magnetic field measurements, can be used to locate casing collars. Chemical sensors can be used to detect the presence of, for example, methane, hydrogen sulfide, and other species. Nuclear detectors, e.g. gamma ray detectors, can be coupled to the optical fibers and used to generate a correlation log to facilitate location of the connector and to track radioactive tracers. Strain, torque and azimuth measurements can be made to obtain information related to the movement of coiled tubing through long, high-angled sections where the tubing is susceptible to buckling. Such measurements also can be used during remedial operations, such as fishing operations, to enable better monitoring of potentially damaging high loads on the coiled tubing. Accelerometer type sensors can be used to provide data on the shock environment to which the coiled tubing is subjected and on the growth of cracks in hydraulic fracturing operations. Additionally, the optical fibers can be used to transfer signals downhole to initiate desired functions.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for sensing a wellbore parameter, comprising:

a coiled tubing having an internal optical fiber disposed within the coiled tubing;

an instrumented section of coiled tubing having a recess extending along its length;

an optical fiber disposed in the recess;

a mechanism to hold the optical fiber along a tubing wall surface of the instrumented section of coiled tubing to facilitate distributed sensing of at least one desired parameter;

a cross-over through which the optical fiber extends to the internal optical fiber; and a coiled tubing connector having an optical fiber passage, wherein the connector is able to communicate data via non-contact telemetry.

2. The system as recited in claim 1, wherein the optical fiber comprises a plurality of optical fibers.

3. The system as recited in claim 1, wherein the recess comprises a plurality of recesses.

4. The system as recited in claim 1, further comprising a connector connecting the optical fiber with the internal optical fiber.

5. The system as recited in claim 4, wherein the connector is located in a bottom hole assembly and the internal optical fiber is deployed in a tube positioned along the interior of the coiled tubing.

6. The system as recited in claim 1, wherein the recess is substantially linear.

7. The system as recited in claim 1, wherein the recess is curved along the coiled tubing.

8. A system for sensing a wellbore parameter, comprising:

a coiled tubing having an internal optical fiber disposed within the coiled tubing;

an instrumented section of coiled tubing having a recess extending along its length;

an optical fiber disposed in the recess;

a mechanism to hold the optical fiber along a tubing wall surface of the instrumented section of coiled tubing to facilitate distributed sensing of at least one desired parameter;

a cross-over through which the optical fiber extends to the internal optical fiber; and a coiled tubing connector having an optical fiber passage, wherein the coiled tubing connector comprises one of a side exit sub and a T-joint sub.

9. A system for sensing a wellbore parameter, comprising:

a coiled tubing having an internal optical fiber disposed within the coiled tubing;

an instrumented section of coiled tubing having a recess extending along its length;

an optical fiber disposed in the recess;

a mechanism to hold the optical fiber along a tubing wall surface of the instrumented section of coiled tubing to facilitate distributed sensing of at least one desired parameter;

a crossover through which the optical fiber extends to the internal optical fiber; and wherein the mechanism comprises a potting material.

10. A method of sensing in a wellbore, comprising:

forming an instrumented section of coiled tubing;

holding an optical fiber at a position to sense at least one well parameter along an exterior tubing surface of the instrumented section of coiled tubing; and routing the optical fiber through a crossover to a coiled tubing interior; and pumping a well fluid along the instrumented section of coiled tubing and adjusting the pumping of well fluid based on distributed measurements of the at least one well parameter.

11. The method as recited in claim 10, wherein holding comprises placing the optical fiber within a recess formed along an exterior of the instrumented section of coiled tubing.

12. The method as recited in claim 10, further comprising using the optical fiber to sense a temperature distribution.

13. The method as recited in claim 10, further comprising using the optical fiber to sense a pressure distribution.

14. The method as recited in claim 10, further comprising using the optical fiber to sense a strain in the coiled tubing.

15. The method as recited in claim 10, further comprising using the optical fiber to sense a vibration along the coiled tubing.

16. The method as recited in claim 10, further comprising coupling the instrumented section of coiled tubing to a non-contact coiled tubing connector.

17. The method as recited in claim 10, further comprising coupling the instrumented section of coiled tubing to a side exit sub coiled tubing connector.

18. The method as recited in claim 10, further comprising coupling the instrumented section of coiled tubing to a T-joint sub coiled tubing connector.

19. A system for using in a wellbore, comprising:

a section of coiled tubing that may be coupled with a standard coiled tubing in a well string;

a sensor array positioned at an outside surface of the section of coiled tubing along the length of the section of coiled tubing, the section of coiled tubing having a diameter extending through the sensor array that is the same as the diameter of the standard coiled tubing; and a crossover through which the sensor array is coupled to an interior control line within the standard coiled tubing.

20. The system as recited in claim 19, wherein the section of coiled tubing comprises a recess, and the sensor array comprises an optical fiber positioned in the recess and held substantially flush with an outside surface of the section of coiled tubing.

21. The system as recited in claim 20, further comprising a second optical fiber disposed in a tube within an interior of the standard coiled tubing; and a connector to connect the optical fiber and the second optical fiber.

22. The system as recited in claim 20, wherein the recess is a groove cut into a wall of the section of coiled tubing, and wherein the optical fiber is hermetically sealed within the recess.

23. The system as recited in claim 20, wherein the optical fiber is hermetically sealed within the recess.

* * * * *